US011279457B1

(12) United States Patent
Craft et al.

(10) Patent No.: US 11,279,457 B1
(45) Date of Patent: Mar. 22, 2022

(54) SLIDEABLE MARITIME STABILIZER FOR ADJACENT MEMBERS

(71) Applicant: Boatlogix, LLC, Chattanooga, TN (US)

(72) Inventors: David A. Craft, Chattanooga, TN (US); Ronald J. Speicher, Chattanooga, TN (US)

(73) Assignee: Boatlogix, LLC, Chattanooga, TN (US)

( * ) Notice: Subject to any disclaimer, the term of this patent is extended or adjusted under 35 U.S.C. 154(b) by 0 days.

(21) Appl. No.: 17/030,102

(22) Filed: Sep. 23, 2020

(51) Int. Cl.
*B63H 20/06* (2006.01)
*B63H 20/00* (2006.01)

(52) U.S. Cl.
CPC ..... *B63H 20/06* (2013.01); *B63H 20/007* (2013.01)

(58) Field of Classification Search
CPC ..... B63H 20/06; B63H 20/007
See application file for complete search history.

(56) References Cited

U.S. PATENT DOCUMENTS 4,432,527 A * 2/1984 Sample ..... B63H 20/007 248/548
9,682,759 B1 * 6/2017 Huntley ..... B63H 20/10
2014/0345133 A1 * 11/2014 Prieto ..... B23D 31/003 29/882
2018/0201354 A1 * 7/2018 Marchio ..... B63H 20/06

* cited by examiner

*Primary Examiner* — Stephen P Avila
(74) *Attorney, Agent, or Firm* — Miller & Martin PLLC

(57) ABSTRACT

Stabilizer is provided for joining parallel shafts in a marine environment and including a split bushing to permit one shaft to move rotationally and longitudinally relative to the stabilizer.

18 Claims, 12 Drawing Sheets

SLIDEABLE MARITIME STABILIZER FOR ADJACENT MEMBERS

FIELD OF THE INVENTION

The present invention relates to a stabilizer device adapted to hold a longitudinal shaft or member in a stable fashion based upon a connection to a parallel longitudinal member that must be allowed to rotate and move longitudinally through the stabilizer device in a marine setting. In a preferred configuration, one portion of the stabilizer attaches to the longitudinal shaft of a submersible sonar unit and another end of the stabilizer clamps about the rotating and height adjustable shaft connecting a mounting head to the motor/propeller assembly of a trolling motor on a fishing boat.

BACKGROUND OF THE INVENTION

In boating, it has become common to utilize numerous electronic devices to facilitate navigation, fishing or exploration, and communication. Particularly in the field of small boat fishing, the use of sonar apparatus to detect both sea bottom characteristics and aquatic activity has become widespread. Most sonar apparatus utilized by sport and recreational fishermen on small boats is designed for only temporary deployment in water and may be removed from water when either the boat is removed from the water or in the event that the boat is used in activities other than fishing. Many fishing boats are now equipped with two distinct types of propulsion devices. For example in bass fishing, which has become a popular competitive sport, fishing boats are often 15 to 25 feet long and utilize as a primary means of propulsion outboard engines having about 40 to 250 horsepower. These larger engines can propel boats at speeds greater than 70 mph and enable anglers to quickly reach desired fishing locations.

However, due to their noise and high propeller revolution speeds, outboard motors are not particularly conducive to attracting fish to proximity of the fishing boat so that anglers also equip their fishing boats with electric trolling motors. Typical trolling motors may provide sufficient propulsion to achieve speeds of three to four mph, with minimal noise and are readily operated with lower propeller speeds.

In addition, the electronic controls for trolling motors have become increasingly sophisticated so that both remote operation and automatically controlled operation is possible. Advertising for the Johnson Outdoors' Minn Kota® Ulterra trolling motor shows a single angler untrailering his fishing boat into a lake with no one aboard the boat. The angler then parks his vehicle and returns to the lakeside where he uses remote control of the trolling motor to steer the boat to the dock so that he can board. Various "smart" trolling motor controls also have the capability of automatically adjusting power and direction to maintain a vessel in a relatively stationary location in spite of wind and current, based upon GPS location. Another popular addition, especially for fishing, is sonar apparatus. Although some trolling motors are provided with built-in transducers, many anglers prefer to selectively install trolling motors and sonar, and high-end sonar apparatus is sold separately.

Typical sonar apparatus used by anglers is either directional or 360° coverage. Among the leading brands are Johnson Outdoors' Humminbird 360 and MEGA 360. This imaging sonar apparatus may be installed to a mount attached to the boat, but for convenience it is frequently desirable to be attached to the trolling motor assembly. In this fashion, only one mounting base needs to be fixed to the boat, and both the sonar and the trolling motor are deployed into the water and retracted from the water at the same time. In the case of the Johnson Outdoors' Minn Kota® Ultrex trolling motor, the company's Humminbird Mega 360 for Ultrex can be mounted to the same assembly. However, while the mounting assembly for the trolling motor provides excellent stability for the motor during transport and non-fishing activity, the transducer end of Mega 360° is unsupported. Similar issues arise when separate sonar transducers are mounted on other trolling motors, such as the Lowrance GHOST, Garmin FORCE and Motorglide TOUR. Thus, both when boats are trailered and towed on the road and when boats are being operated at high speed or on choppy water using outboard motor propulsion, the sonar head is in a horizontal withdrawn position out of the water where it is relatively unsupported and more likely to suffer vibratory damage. Anglers have been known to utilize various DIY solutions such as binding the sonar apparatus to the trolling motor apparatus with Styrofoam block spacers and bungee cords. These solutions are neither convenient nor durable.

Joining the shafts of the Mega 360 imaging apparatus and the trolling motor is non-trivial since the shaft of the trolling motor rotates during use according to the orientation of the propeller. In addition, the trolling motor shaft may be adjustable in the longitudinal direction since an angler may prefer relatively deeper deployment of the trolling motor propeller in deep water and a relatively shallow deployment of the propeller for shallow water or close to shore. Furthermore, using some type of joining mechanism that required disassembling the trolling motor to slide over the shaft would be a complication that would hinder the adoption of the mechanism. The use of bearings with circular races in joining the shafts would also require sliding the bearing over the end of the trolling motor shaft after disassembly.

Prior art efforts to secure the sonar apparatus in conjunction with trolling motor suffer from short comings of durability, inadequate vibratory protection, and the requirement of repeated attachment and detachment when the sonar goes into and out of use. A key to the present stabilizing system is the use of split ring connections to encircle each of the adjacent shafts and the use of a split bushing within the ring encircling the trolling motor shaft which permits the trolling motor shaft to both rotate and slide while still maintaining relative position to the shaft of the sonar apparatus. The structure also allows fitting of the stabilizer without disassembling either the trolling motor assembly or the sonar imaging assembly.

BRIEF DESCRIPTION OF THE DRAWINGS

The features of the invention will be better understood by referencing the accompanying drawings depicting various applications and embodiments of the invention.

DETAILED DESCRIPTION OF THE INVENTION

Figure 1:
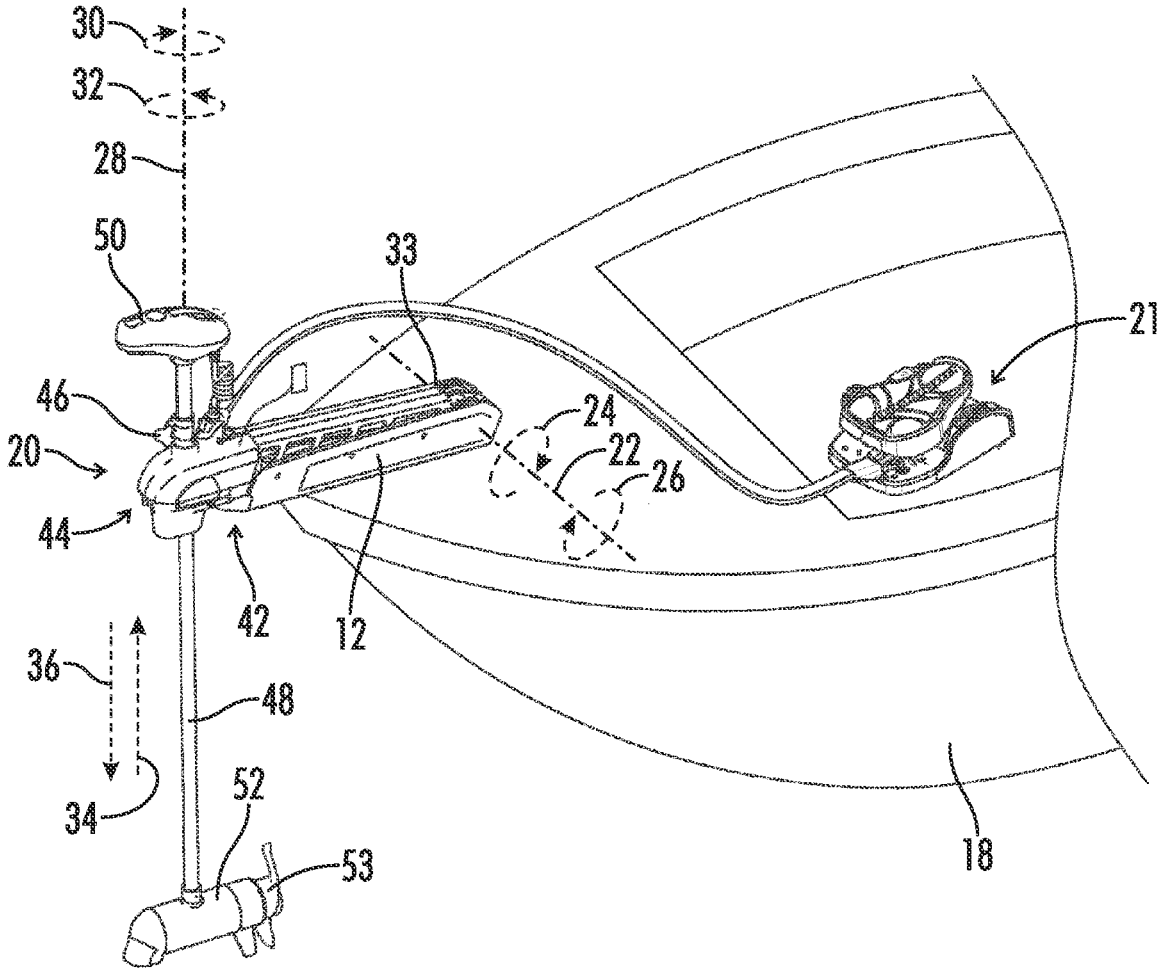
FIG. 1 (PRIOR ART)
FIG. 1 is a perspective view of a trolling motor of the general style of the Johnson Outdoors' Minn Kota® Ultrex taken from U.S. Pat. No. 9,676,462 shown mounted to a watercraft in deployed position.

In FIG. 1, trolling motor 20 is shown mounted at the bow of a schematically represented watercraft 18. Trolling motor 20 includes a base assembly 42 mounting trolling motor unit 20 to watercraft 18. Trolling motor unit 20 also includes a steering module 44 which effectuates the steering capabilities of trolling motor unit 20, a depth collar 46 (in some cases replaced by an automated trim module or power depth collar) which effectuates trim adjustment of trolling motor unit 20 by allowing adjustment of the vertical position of a motor shaft assembly comprising a motor shaft 48, as well as a head unit 50 and motor power unit 52 mounted at opposed ends of motor shaft 48. Head unit 50 may include appropriate control circuitry to achieve desired functionalities and may include additional navigational electronics such as GPS navigational systems and wireless communication systems. Motor power unit 52 includes an internal electric drive motor and its associated componentry to effectuate the rotation of a propeller 53 of motor power unit 52. An optional remote foot control 21 is also illustrated, however, alternate wireless remote control is also possible.

Figure 2:
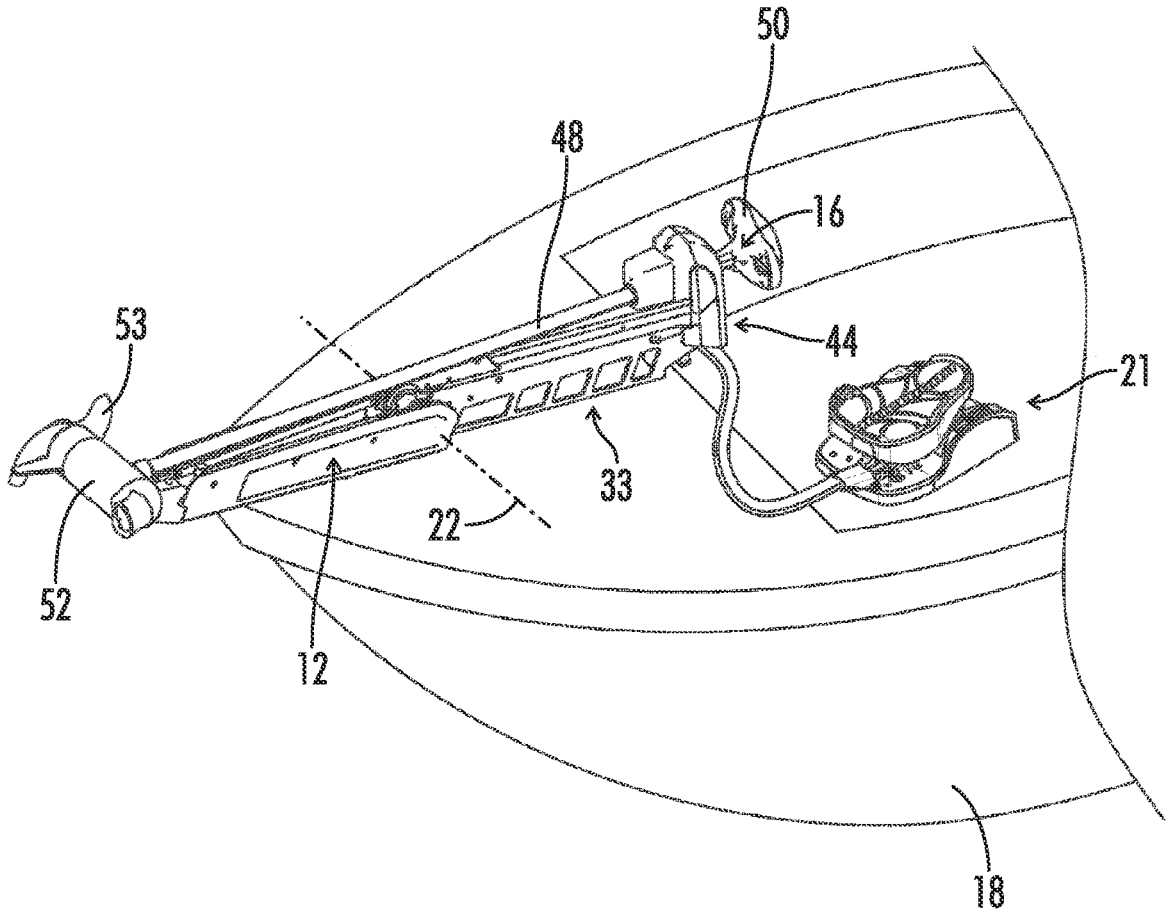
FIG. 2 (PRIOR ART)
FIG. 2 is a perspective view of the trolling motor of FIG. 1 shown mounted to a watercraft in retracted position.

More specifically, trolling motor unit defines a first axis 22 about which extension arm 33, which is connected to steering module 44 which holds the motor shaft 48 with head unit 50 and motor power unit 52 at opposite ends, is rotatable in first and second rotational directions 24, 26. Rotation of the arm 33 and these connected components about first axis 22 in first rotational direction 24 and adjustment of the orientation of the shaft 48 will place trolling motor unit in a stowed position as shown in FIG. 2 wherein trolling motor unit 20 is not operable to provide any positioning of watercraft 18. These components are rotatable about first axis 22 in the second rotational direction 26 from the stowed position to place trolling motor unit 20 in a deployed position wherein trolling motor unit 20 is operable to govern the positioning of watercraft 18.

Trolling motor unit 20 also defines a second axis 28. Motor shaft 48, head unit 50, and motor power unit 52 are rotatable in first and second rotational directions 30, 32 about second axis 28 to effectuate the steering of watercraft 18 by directing thrust provided by motor power unit 52. Motor shaft 48, head unit 50, and motor power unit 52 are also vertically adjustable along the second axis 28 in first and second linear directions 34, 36 to provide for the aforementioned trim adjustment by changing the vertical position of motor power unit 52 relative to base assembly 42.

As can be seen from inspection of FIG. 2, when in the stowed position, trolling motor unit 20 is positioned with the shaft 48 in a generally horizontal configuration and secured in place when not in use. Although not illustrated, trolling motor 20 may also include strap, cradles, or other components to maintain the trolling motor and shaft 48 in this position. When a user is ready to deploy trolling motor unit 20, a stow/deploy arrangement of trolling motor unit 20 is operable to rotate the aforementioned components of trolling motor unit 20 about first axis 22 in second rotational direction 26 (See FIG. 1). Most typically, trolling motors are mounted in a fashion that allows them to be deployed to a desired depth while in the water and allow the motors to be pivoted and stood horizontal to the deck of the watercraft. Examples of these structures are shown in FIGS. 1 through 3.

Figure 3:
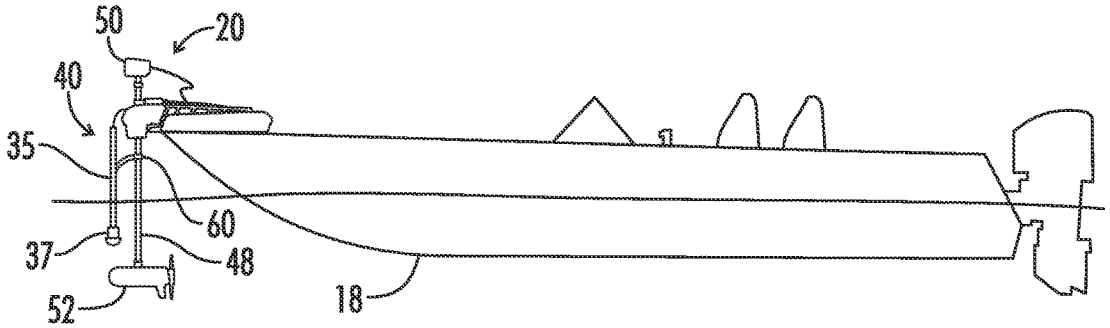
FIG. 3 (PRIOR ART)
FIG. 3 illustrates a trolling motor device with a mounting unit secured to the watercraft and attached sonar apparatus mounted only to a trolling motor shaft housing in deployed position.

In the configuration of FIG. 3, a mounting bracket 60*a* connects directly between the trolling motor shaft 48 and the imager shaft 35. This configuration is only practicable if the clamped portion of the trolling motor shaft 48 is not rotated. Rotation would reorient the transducer head 37 and create a variety of operational and structural concerns. However, when it is possible to directly and fixedly mount the imager shaft 35 to a fixed trolling motor shaft 48, it is often possible to use a shorter imager shaft 35, so that the unsupported length of the imager shaft 35 is relatively short and there in less vibratory movement imparted to the transducer 37 when retracted. In such cases, a stabilizer 80 is not necessarily needed.

Figure 4:
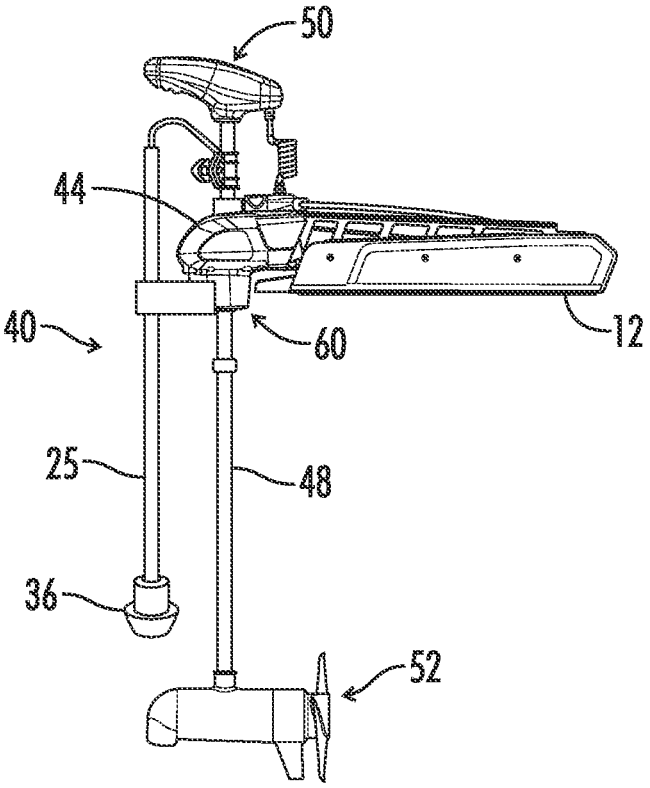
FIG. 4 (PRIOR ART)
FIG. 4 is a perspective view of the trolling motor of the style in FIG. 1 with a transducer device mounted below a steering module, shown in isolation.
Figure 5:
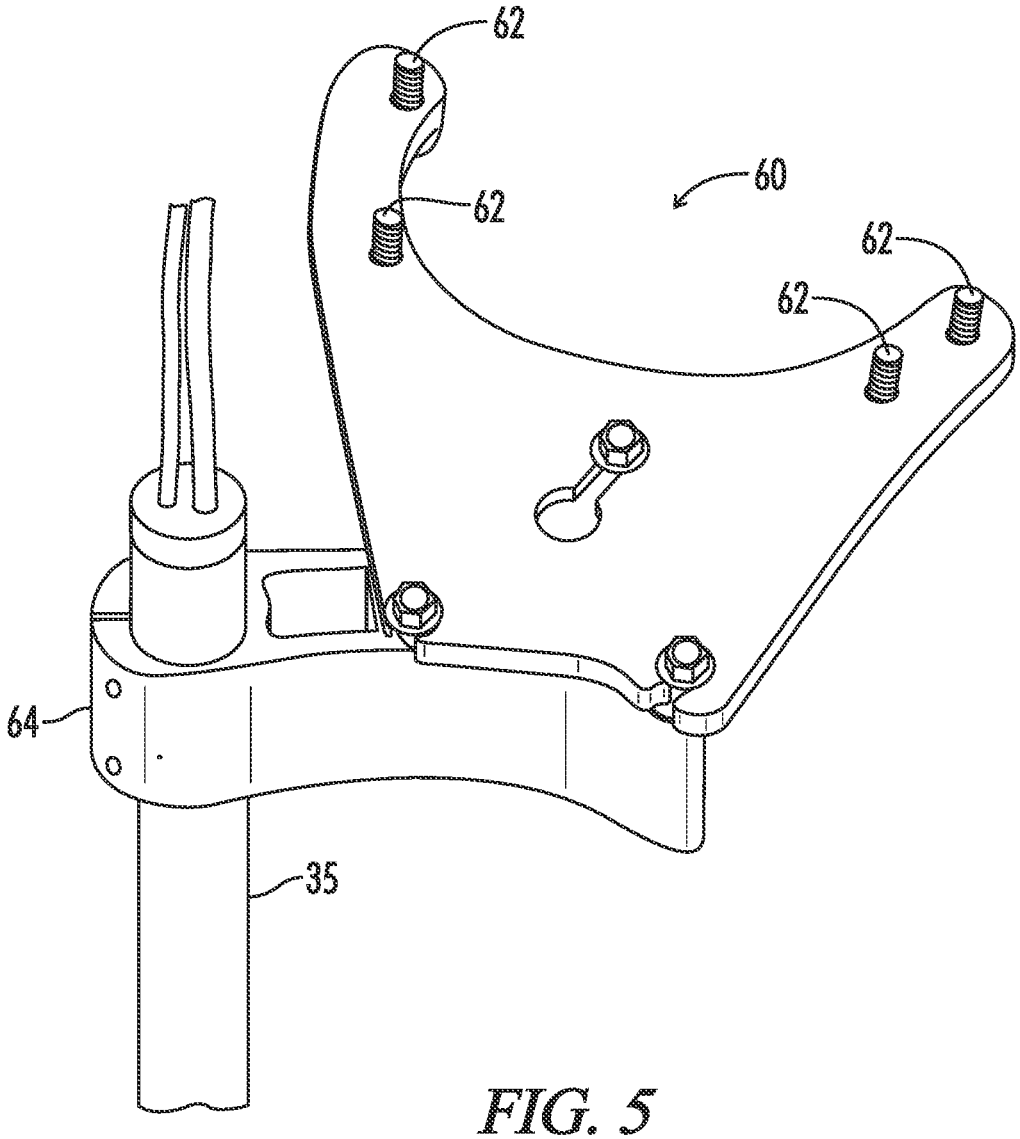
FIG. 5 (PRIOR ART)
FIG. 5 is perspective view of the prior art mounting plate assembly that connects the upper end of a transducer device to the bottom of the power steering module of the trolling motor assembly.

In FIG. 4, a prior art mounting of a 360° scanning device is shown with mounting block 12 or trolling motor base secured to watercraft deck and trolling motor shaft 48 descending downward into the water with trolling motor power unit 52. The trolling motor power unit and propeller is rotatable to propel the watercraft in the desired direction. In the illustrated embodiment, a steering module 44 rotates the shaft 48 to orient the power unit 52 and propeller 53 to direct the propulsion of the boat 18. A specialized mounting plate 60*b* shown in detail in FIG. 5 may be affixed to the bottom of trolling motor steering module 44 with threaded fasteners 62 especially positioned for that purpose. The trolling motor shaft 48 passes through the steering module 44 that is secured to the mounting block 12. The imager shaft 35 extends downward with the transducer head 37 into the water. A clamping collar 64 secured to the imager shaft 35 prevents any movement of shaft 35 so that transducer head 37 must be mounted sufficiently high to allow for depth wise adjustment of the trolling motor power unit 52. The mounting plate 60*b* provides a fixed connection between the base 12 and the imager shaft 35.

Figure 6:
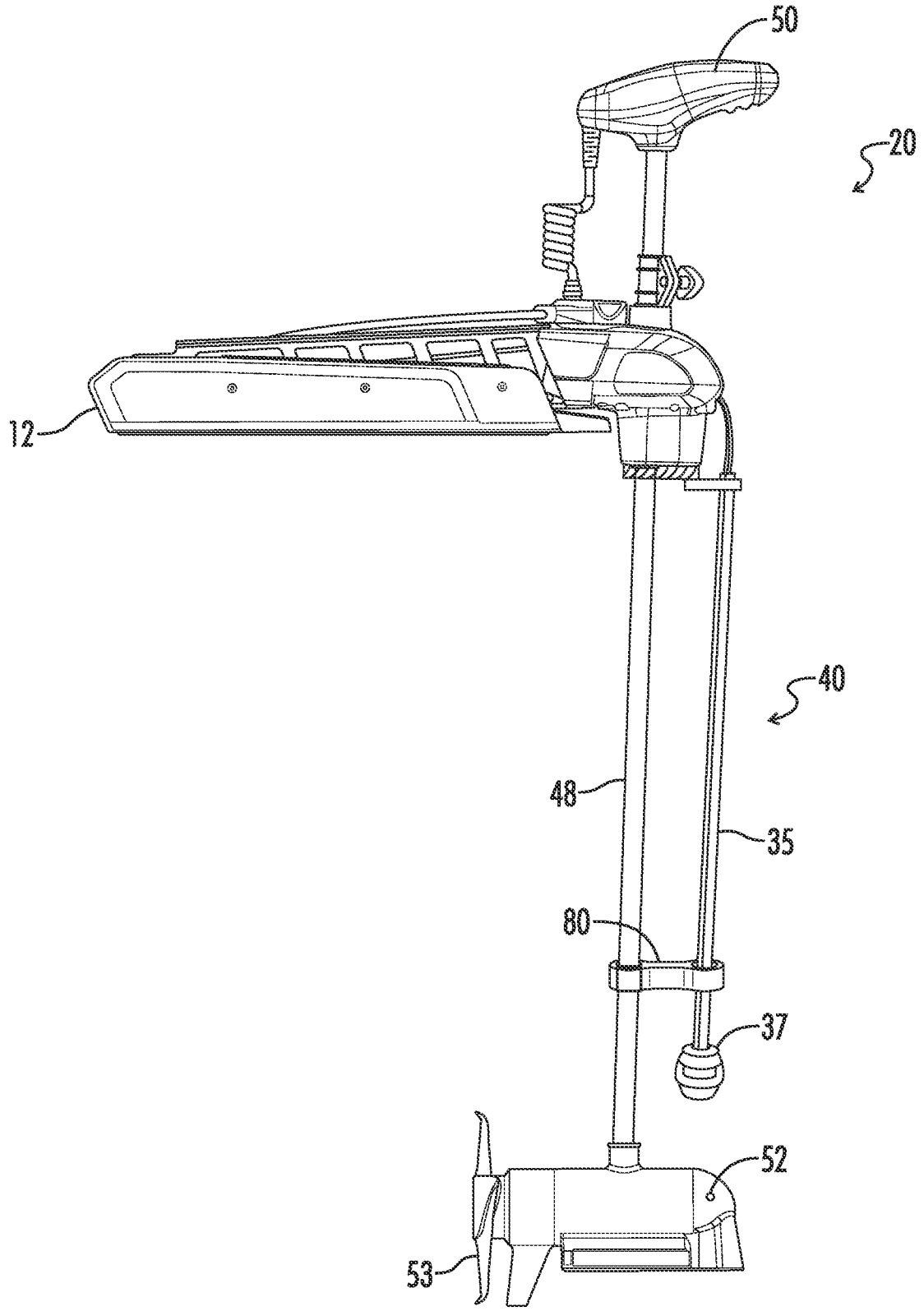
FIG. 6 is a perspective view of the trolling motor and sonar device of FIG. 4 with a stabilizer according to the present invention in deployed position.
Figure 7:
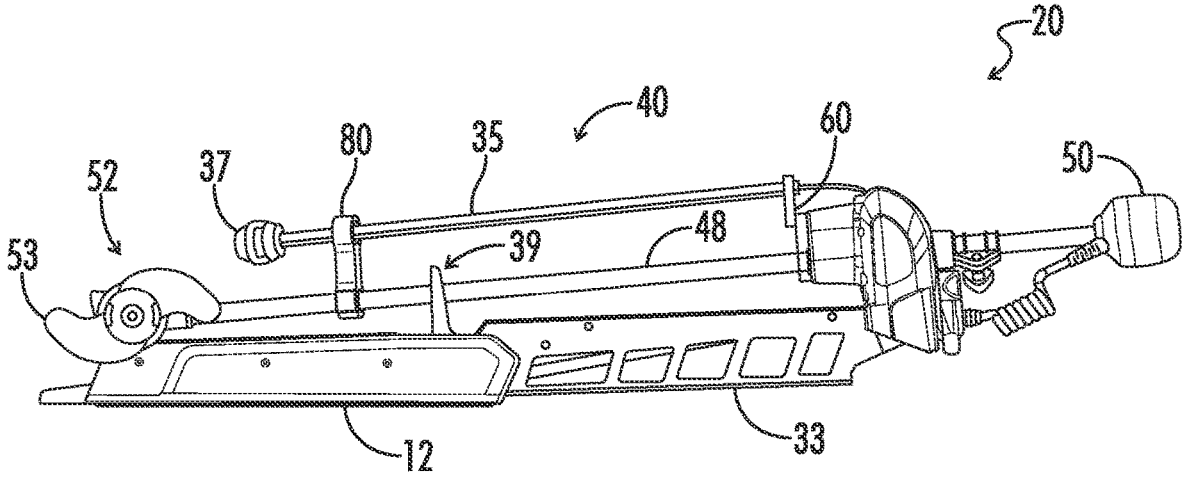
FIG. 7 is a perspective view of a trolling motor and sonar device of FIG. 6 in retracted position.

FIG. 6 depicts a trolling motor 20 and sonar/transducer device 40 with a stabilizer 80 according to the present invention. The stabilizer 80 connects the trolling motor shaft 48 and imager shaft 35 proximate the imager head 37. FIG. 7 depicts the same trolling motor 20 and sonar apparatus 40 in retracted position where the trolling motor shaft 48 and imager shaft 35 are nearly horizontal to the watercraft deck. It can be seen that the trolling motor 20 is secured with the power unit 52 resting in a cradle, the motor shaft 48 supported nearer a midpoint by another cradle 39, and the steering module being securely fastened to the end of the deployment arm 33 that pivots over and into base 12 when the trolling motor is deployed into the water over the side watercraft 18. The combination of mounting plate 60 at the upper end of imager shaft 35 and stabilizer 80 the lower end of imager shaft 35 holds the transducer head 37 in a much more stable position than if the lower end of imager shaft 35 was unsupported.

Figure 8:
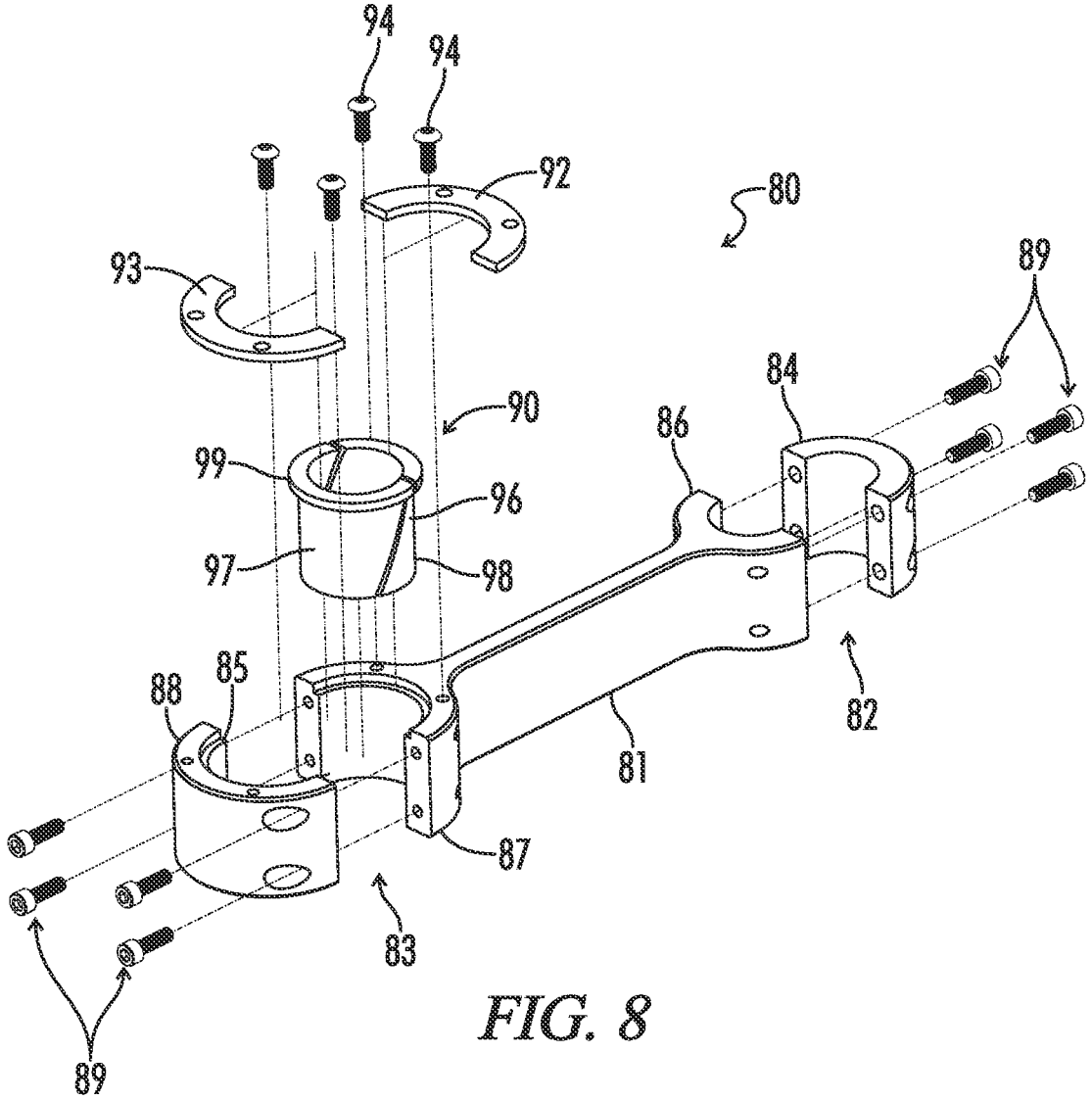
FIG. 8 is an exploded perspective view of a stabilizer according to the invention.

In FIG. 8, stabilizer 80 is depicted with stabilizer bar 81 and two split rod connectors 82 and 83. The first split rod connector 83 is designed to secure to trolling motor shaft 48 and the Y-shaped end 87 of stabilizer bar 81 at this first end is connected to cover 88 about the trolling motor shaft using a plurality of fasteners such as threaded screws 89. At the second end, an opposite Y-shaped end 86 is connected with cover 84, again using a plurality of fasteners. This second end connection can be made around the imager shaft 35 where there is no need for the stabilizer 80 to permit the imager shaft 35 to move relative to the stabilizer. However, because the trolling motor shaft 48 must be permitted to slide and rotate the first split connector 83 contains a split bushing 90 held in position by semi-circular cover pieces 92, 93 that are fastened to the Y-shaped end 87 and connecting cover 88 with fasteners such as screws 94. The split bushing 90 is preferably made of two matching pieces of self-lubricating plastic material cut along a diagonal 96 to minimize the chance of interference from any vertical seams on shaft 48. Bushing pieces 97, 98 have an upper flange 99 that is received in recess 85 along the top of the Y-shaped end 87 and cover 88 of the second connecting joint.

Figure 9:
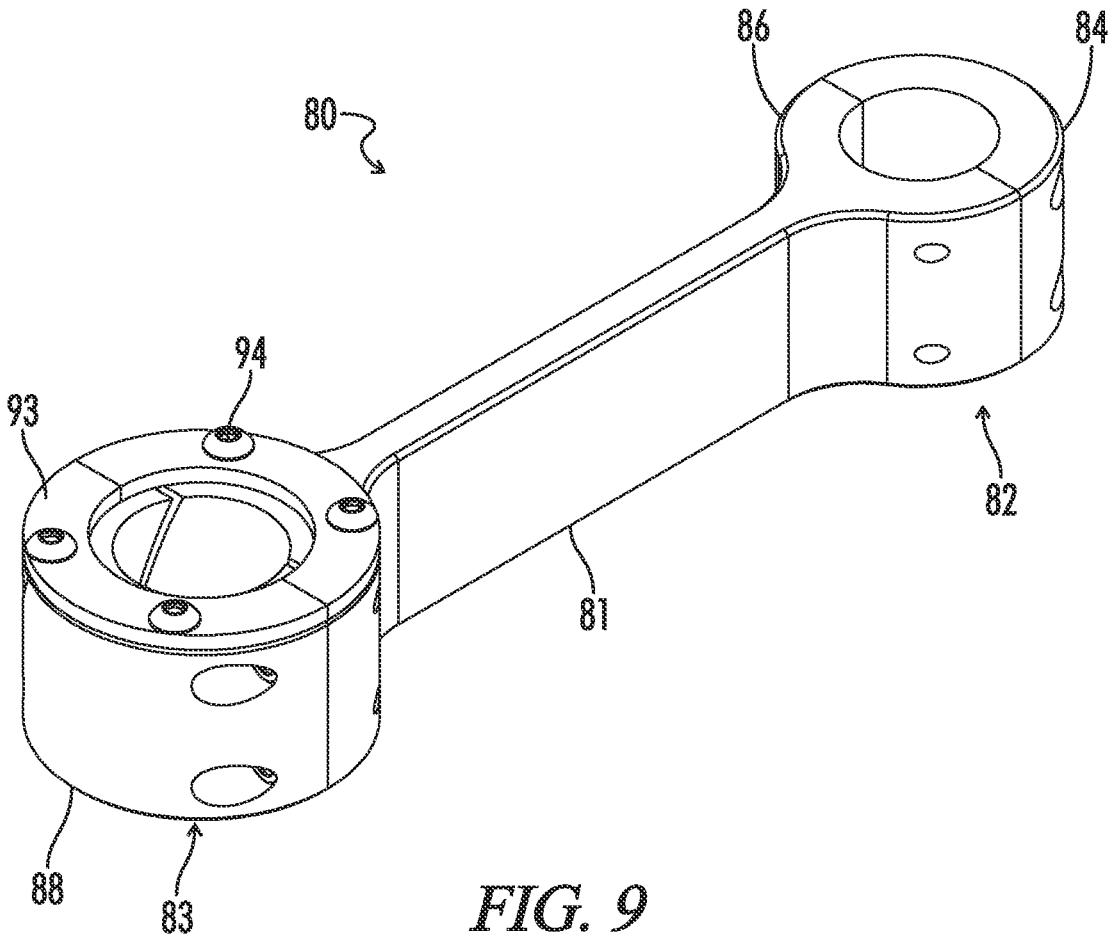
FIG. 9 is a perspective view of an assembled stabilizer according to the embodiment of FIG. 8.

The assembled stabilizer 80 is shown in FIG. 9 and it will be understood that the imager shaft 35 would pass through the opening in the second split rod connector 82. The ability to fasten cover 84 to the Y-joint 86 and means that the imager apparatus, such as transducer head 37, does not need to be disassembled in order to affix the stabilizer 80. So, for instance, it might seem that the use of a bearing structure to encircle a shaft could be desirable, however, a unitary component that encircles a shaft must be fitted over a shaft end, requiring removal of any apparatus on the ends of the shaft. It will also be understood that the trolling motor shaft 48 passes through the opening in the first split rod connector 83. In a similar fashion, the use of a split bushing 90 and the Y-shaped end 87 with cover 88 that may be fastened together as by screws 89 permits the stabilizer to be mounted on the motor shaft without disassembling the trolling motor apparatus 20. The split bushing pieces 97, 98 housed within the second split rod connector rotate within the opening and thereby accommodate movement of the trolling motor shaft 48 around the axis 28 in directors 30 and 32 as shown on FIG. 1. Since the rotational and longitudinal movement of the trolling motor shaft is generally measured in speed and distance, a bushing structure provides suitable functionality. In addition, the bushing pieces are preferably made of a self-lubricating plastic material that so that trolling motor shaft 48 may glide within the second split rod connector in the vertical directions 34, 36 as the depth of the trolling motor propulsion unit 52 is adjusted.

The stabilizer 80 is designed for marine use and periodic immersion, and to withstand sustained vibration, all without requiring extensive maintenance. The use of the stabilizer permits the creation of a rectangular structure comprised of parallel trolling motor shaft 48 and imager shaft 35 sections, with stabilizer 80 toward the lower ends, and an upper connector such as the mounting plate 60 shown in FIG. 5. Such a rectangular configuration can be structurally sound, and in any event the stabilizer 80 ensures there is not a long segment of unsupported imager shaft 35 carrying the transducer head 37.

Figure 10:
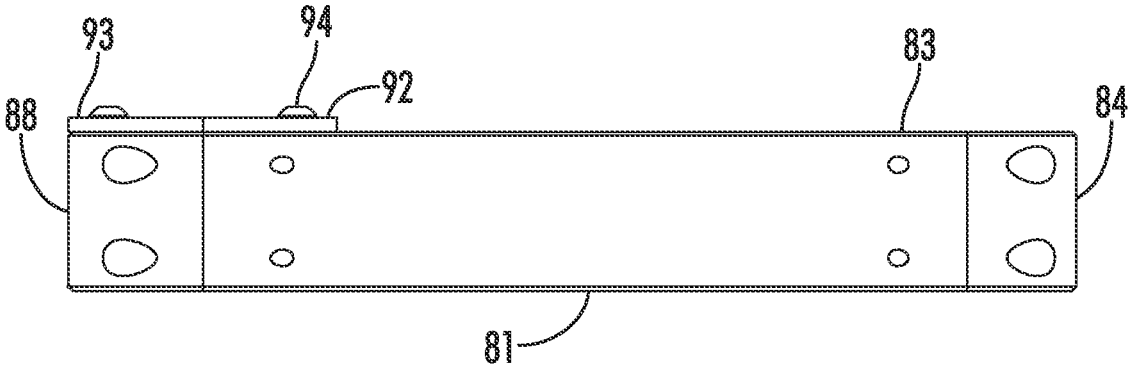
FIG. 10 is a side plan view of the stabilizer of FIG. 9.
Figure 11:
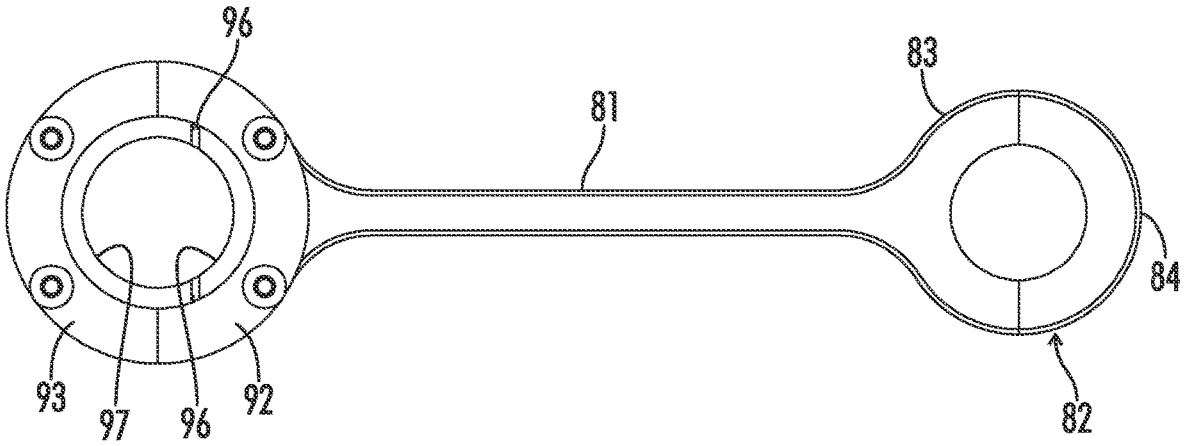
FIG. 11 is a top plan view of the stabilizer of FIG. 9.
Figure 12:
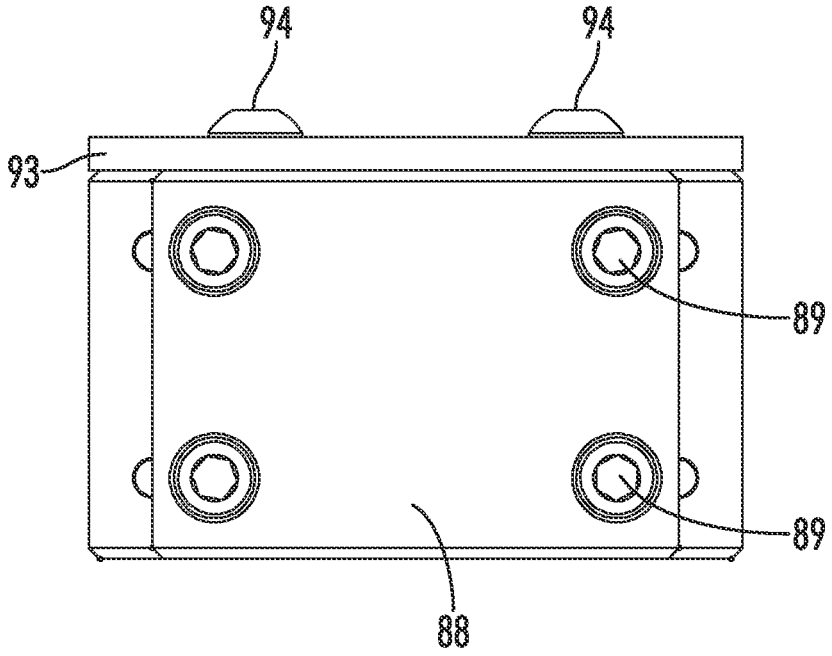
FIG. 12 is a front plan view of the stabilizer of FIG. 9.

FIG. 10-12 show side, top and end plan views of stabilizer 80.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed herein is:

1. A marine stabilizer comprising a stabilizer bar with first end having a first split rod connector and a second end having a second split rod connector wherein:

the first split rod connector comprises a Y-joint at the first end of the stabilizer bar releasably fastened to a cover;

the second split rod connector comprises a Y-joint at the second end of the stabilizer bar releasably fasted to a cover, and the second split rod connector containing within the cover and the Y-joint, a split bushing that permits rotational movement of a shaft passing through the second split rod connector and permits the longitudinal movement of a shaft passing through the second split rod connector;

wherein the split bushing is made of two semi-circular matching pieces cut along a diagonal.

2. The marine stabilizer of claim 1, wherein the bushing pieces have an upper outwardly extending flange received in a recess along the top of the Y-joint and cover of the second split rod connector.

3. The marine stabilizer of claim 2, wherein the outwardly extending flanges are constrained in the recess by at least two cover pieces fastened to the Y-joint and cover.

4. The marine stabilizer of claim 3 wherein the Y-joints and associated connectors are releasably fastened with screws.

5. A stabilized trolling motor and transducer apparatus combination having a trolling motor with a base assembly attached to a boat, a trolling motor shaft passing through the base assembly, said trolling motor shaft having a top end with a head and a bottom end with a propulsion assembly; and the transducer assembly having an imager shaft with a transducer at a bottom end, a middle section, and an opposite top end with a fixed connector joining the opposite top end to the trolling motor base assembly, wherein the combination is stabilized by a stabilizer bar with first end having a first split rod connector and a second end having a second split rod connector wherein:

the first split rod connector comprises a Y-joint at the first end of the stabilizer bar releasably fastened to a cover around the middle section of the imager shaft;

the second split rod connector comprises a Y-joint at the second end of the stabilizer bar releasably fasted to a cover around the trolling motor shaft above the bottom end, and the second split rod connector containing within the cover and the Y-joint, a split bushing that permits rotational movement of the trolling motor shaft.

6. The stabilized trolling motor and transducer apparatus combination of claim 5, wherein the second split rod connector further permits the longitudinal movement of the trolling motor shaft.

7. The stabilized trolling motor and transducer apparatus combination of claim 5, wherein the split bushing is made of two semi-circular matching pieces cut along a diagonal.

8. The stabilized trolling motor and transducer apparatus combination claim 7, wherein the bushing pieces have an upper outwardly extending flange received in a recess along the top of the Y-joint and cover of the second split rod connector.

9. The stabilized trolling motor and transducer apparatus combination claim 8, wherein the outwardly extending flanges are constrained in the recess by at least two bushing cover pieces fastened to the Y-joint and cover.

10. The stabilized trolling motor and transducer apparatus combination claim 9 wherein the Y-joints and associated connectors are releasably fastened with screws.

11. A method of stabilizing a trolling motor and separate marine transducer apparatus wherein the trolling motor has a base assembly attached to a boat, a trolling motor shaft passing through the base assembly, said trolling motor shaft having a top end with a head and a bottom end with a propulsion assembly; and the transducer assembly having an imager shaft with a transducer at a bottom end, a middle section, and an opposite top end comprising the steps of:

joining the trolling motor base assembly to a portion of the imager shaft proximate the top end;

positioning a stabilizer bar having a first Y-joint at a first end and a second Y-joint at a second end with the first Y-joint on the middle section of the imager shaft and the second Y-joint on the trolling motor shaft above the bottom end;

fastening a cover to the first Y-joint around the imager shaft;

positioning pieces of a split bushing around the trolling motor shaft at the second Y-joint and fastening a cover to the second Y-joint about the split bushing pieces and trolling motor shaft.

12. The method of claim 11, wherein the second split rod connector further permits the longitudinal movement of the trolling motor shaft.

13. The method of claim 11, wherein the split bushing is made of two semi-circular matching pieces cut along a diagonal.

14. The method of claim 13, wherein the bushing pieces have an upper outwardly extending flange received in a recess along the top of the second Y-joint and its cover.

15. The method of claim 14, wherein the outwardly extending flanges are constrained in the recess by at least two bushing cover pieces fastened to the Y-joint and cover.

16. The method of claim 15, wherein the Y-joints and associated covers are releasably fastened with screws.

17. The method of claim 11 wherein the trolling motor shaft and the imager shaft are rotatable from a vertical deployed position to a horizontal stowed position.

18. The method of claim 11 wherein the trolling motor shaft and the imager shaft are positioned as substantially parallel from top to bottom.

* * * * *